US008439230B2

(12) United States Patent
Hagen

(10) Patent No.: US 8,439,230 B2
(45) Date of Patent: May 14, 2013

(54) DISPENSER HAVING DISPENSING HEAD MOVEABLE BETWEEN USE AND NON-USE POSITIONS

(75) Inventor: Holger Hagen, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 322 days.

(21) Appl. No.: 12/736,349

(22) PCT Filed: Apr. 15, 2009

(86) PCT No.: PCT/EP2009/054450

§ 371 (c)(1),
(2), (4) Date: Sep. 30, 2010

(87) PCT Pub. No.: WO2009/127651

PCT Pub. Date: Oct. 22, 2009

(65) Prior Publication Data

US 2011/0031282 A1 Feb. 10, 2011

(30) Foreign Application Priority Data

Apr. 15, 2008 (DE) ..... 10 2008 019 007

(51) Int. Cl.
*B67B 1/00* (2006.01)
*B67D 3/00* (2006.01)

(52) U.S. Cl.
USPC ..... 222/153.13; 222/321.7; 222/384; 222/519; 222/538

(58) Field of Classification Search ..... 222/153.13, 222/256, 320, 321.1, 321.7, 383.1, 386, 519, 222/538, 384
See application file for complete search history.

(56) References Cited

U.S. PATENT DOCUMENTS

| | | | | |
|---|---|---|---|---|
| 1,502,298 | A * | 7/1924 | Dyer | 222/335 |
| 1,903,464 | A * | 4/1933 | Konanz | 222/551 |
| 5,085,347 | A * | 2/1992 | Hayes et al. | 222/153.02 |
| 5,203,841 | A * | 4/1993 | Kitabayashi | 222/402.11 |
| 5,615,806 | A * | 4/1997 | Grothoff | 222/153.13 |
| 6,209,103 | B1 * | 3/2001 | Schreiber et al. | 726/26 |

(Continued)

FOREIGN PATENT DOCUMENTS

| | | |
|---|---|---|
| DE | 10 2007 007 402 | 8/2007 |
| EP | 1 829 791 | 9/2007 |

(Continued)

OTHER PUBLICATIONS

International Search Report, PCT/EP2009/054450, Jul. 8, 2009.

*Primary Examiner* — Kevin P Shaver
*Assistant Examiner* — Patrick M Buechner
(74) *Attorney, Agent, or Firm* — Collard & Roe, P.C.

(57) ABSTRACT

A dispenser for dispensing liquid to pasty substances has a dispensing head with a dispensing mouth, a supply chamber and a dispenser head part. The dispensing head can be displaced relative to the dispenser head part out of a dispensing-standby position into a lowered position and vice versa. It is possible for the dispensing head, as a result of being supported on a fixed dispenser part, to be extended or retracted relative to the fixed dispenser part when rotated by the dispenser head part. The dispenser head covers over a dispensing tube that communicates with the pumping chamber. In order to achieve a favorable configuration of the substance path during the extension and retraction of the dispensing head. The dispensing head, in the extended position, interacts in an aligned manner with the dispensing opening and, in the retracted position, interacts with a closed region of the dispensing tube.

5 Claims, 11 Drawing Sheets

U.S. PATENT DOCUMENTS

| | | | | |
|---|---|---|---|---|
| 6,405,904 | B1 * | 6/2002 | De Laforcade | 222/321.3 |
| 7,735,692 | B2 * | 6/2010 | Nelson | 222/190 |
| 7,775,402 | B2 * | 8/2010 | Yoshida et al. | 222/153.13 |
| 2004/0060945 | A1 * | 4/2004 | Cater et al. | 222/1 |
| 2008/0023498 | A1 | 1/2008 | Bertin et al. | |
| 2012/0292344 | A1 * | 11/2012 | Bertin et al. | 222/153.13 |

FOREIGN PATENT DOCUMENTS

| | | |
|---|---|---|
| FR | 2 854 390 | 11/2004 |
| WO | WO 2008/010640 | 1/2008 |
| WO | WO 2008/012455 | 1/2008 |

* cited by examiner

DISPENSER HAVING DISPENSING HEAD MOVEABLE BETWEEN USE AND NON-USE POSITIONS

CROSS REFERENCE TO RELATED APPLICATIONS

This application is the National Stage of PCT/EP2009/054450 filed on Apr. 15, 2009, which claims priority under 35 U.S.C. §119 of German Application No. 10 2008 019 007.1 filed on Apr. 15, 2008, the disclosure of which is incorporated by reference. The international application under PCT article 21(2) was not published in English.

The invention relates to a dispenser for dispensing liquid to pasty substances, having a dispensing head with a dispensing mouth, having a supply chamber and having a dispenser head part, it being possible for the dispensing head to be displaced relative to the dispenser head part out of a dispensing-standby position into a lowered position and vice versa, it being possible for the dispensing head, as a result of being supported on a fixed dispenser part, to be extended or retracted relative to the fixed dispenser part when being carried along in rotation by the dispenser head part, and the dispenser head covering over a dispensing tube that communicates with the pumping chamber.

In respect of the prior art, reference is made, for example, to DE 10 2007 007 402 A1. In the dispenser known from the latter, cf., for example, FIGS. 7 to 9 of this document, the dispensing head is firmly connected to a pumping-chamber part which can be pushed down for pumping movement. The dispenser head part can be moved downward by a screwing movement in order for the dispensing head with the dispensing mouth to be displaced into a dispensing-standby position.

In addition, reference is made to WO 2008/010640 A and WO 2008/012455 A. In the case of the subject of WO 2008/010640 A, during extension and retraction of the dispensing head, the pump chamber and the supply container are moved along in the same manner. In the case of the subject of WO 2008/012455 A, during extension and retraction of the dispensing head, a flexible hose portion of the dispensing tube changes from a rolled-up position into an extended position and vice versa.

Proceeding from the last-mentioned state of the art, the invention is concerned with the technical problem of achieving a favorable configuration of the substance path during the extension and retraction of the dispensing head in respect of a relative movement between the pumping chamber and the dispensing head.

This technical problem is solved by a dispenser in which the dispensing head (3), in the extended position, interacts in an aligned manner with the dispensing opening and, in the retracted position, interacts with a closed region of the dispensing tube (21).

It is further preferred if the dispenser head part has a vertically accessible recess into which and out of which moves a projecting dispensing nozzle of the dispenser head. In the retracted state, an advantageous concealed position of the dispensing nozzle is thus achieved. This can also be used for closing the dispensing nozzle.

It is preferred if the dispenser head part can be rotated relative to the supply container. A user can secure the dispenser on the supply container and then set the desired position of the dispensing head by rotation of the dispenser head part.

Furthermore, it is preferred if the dispensing head is guided by a slotted track relative to a fixed dispenser part which is formed as an adjustment part. Support of the dispensing head on the fixed dispenser part is effected by the slotted-track guidance. Advantageous latching installation is made possible.

It is also preferred if the dispensing head covers over a dispensing tube which communicates with the pumping chamber. The dispensing tube here, further preferably, is firmly connected to an upper pumping-chamber part, in particular the piston part, whereas the dispensing head, formed in the manner of a sleeve in this respect, can be moved telescopically in relation to the dispensing tube.

By virtue of the dispensing head, in the extended position, interacting in an aligned manner with a dispensing opening of the dispenser tube, but, in the retracted position, interacting with a closed region of the dispenser tube, closure or opening of the substance-dispensing path is thus achieved, at the same time, along with the retraction and extension of the dispensing head.

The invention will be explained hereinbelow, furthermore, with reference to the accompanying drawing, although the latter illustrates merely an exemplary embodiment. In the drawing.

Figure 1:
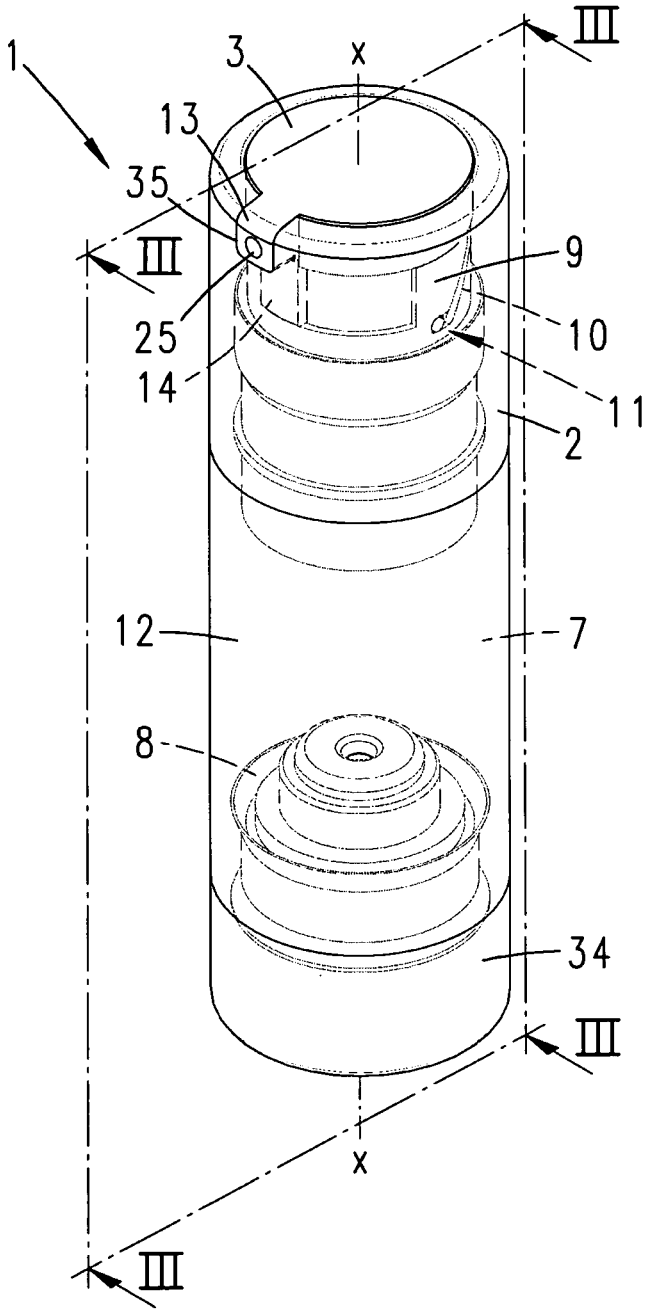
FIG. 1 shows a schematic view, in perspective, of the dispenser with the dispensing head retracted.

A dispenser 1 which serves for dispensing liquid to pasty substances is illustrated and described, in first instance with reference to FIG. 1. It has a dispensing head 3 accommodated in a dispenser head part 2, which at the same time forms the outer surface. The dispensing head 3 adjoins, in the upward direction, a pumping chamber 4, see FIG. 3, the pumping chamber having an inlet valve 5 and an outlet valve 6. It is also possible for just one valve to be provided.

The pumping chamber 4 has beneath it a supply chamber 7, in which, for example, a feeding piston 8 may be disposed. The dispenser head part 2, furthermore, has disposed in it a fixed adjustment part 9, which has a slotted actuating track 10 in which run one or more follower elements 11 of the dispensing head 3.

The dispensing head part 2 is configured in the manner of a sleeve. It is of tubular form with a U-wall formed at the upper end. The outer wall merges cross-sectionally, via a U-crosspiece, into a wall crosspiece which projects freely inward. The U-crosspiece forms an outer, annularly encircling end surface. In the region of the recess 35 for the dispensing mouth 25, the wall is preferably formed only in an angled manner, without an inner U-leg.

The dispensing head 3 is coupled positively to the dispenser head part 2, which is retained such that it can be rotated relative to a dispenser sleeve part 12. However, it cannot be moved vertically relative to the dispenser sleeve part 12.

The rotary coupling between the dispenser head part 2 and the dispensing head 3 is achieved, in specific terms, by a drive protrusion 14 which is formed on the dispensing head 3, in the exemplary embodiment beneath the dispensing mouth 25, and engages in an associated entrainment recess inside the dispenser head part 2.

The pumping chamber 4, more specifically, is formed by a fixed lower pumping-chamber part 15 and an upper pumping-chamber part 16, which can be moved vertically in relation to this lower part 15.

Figure 5:
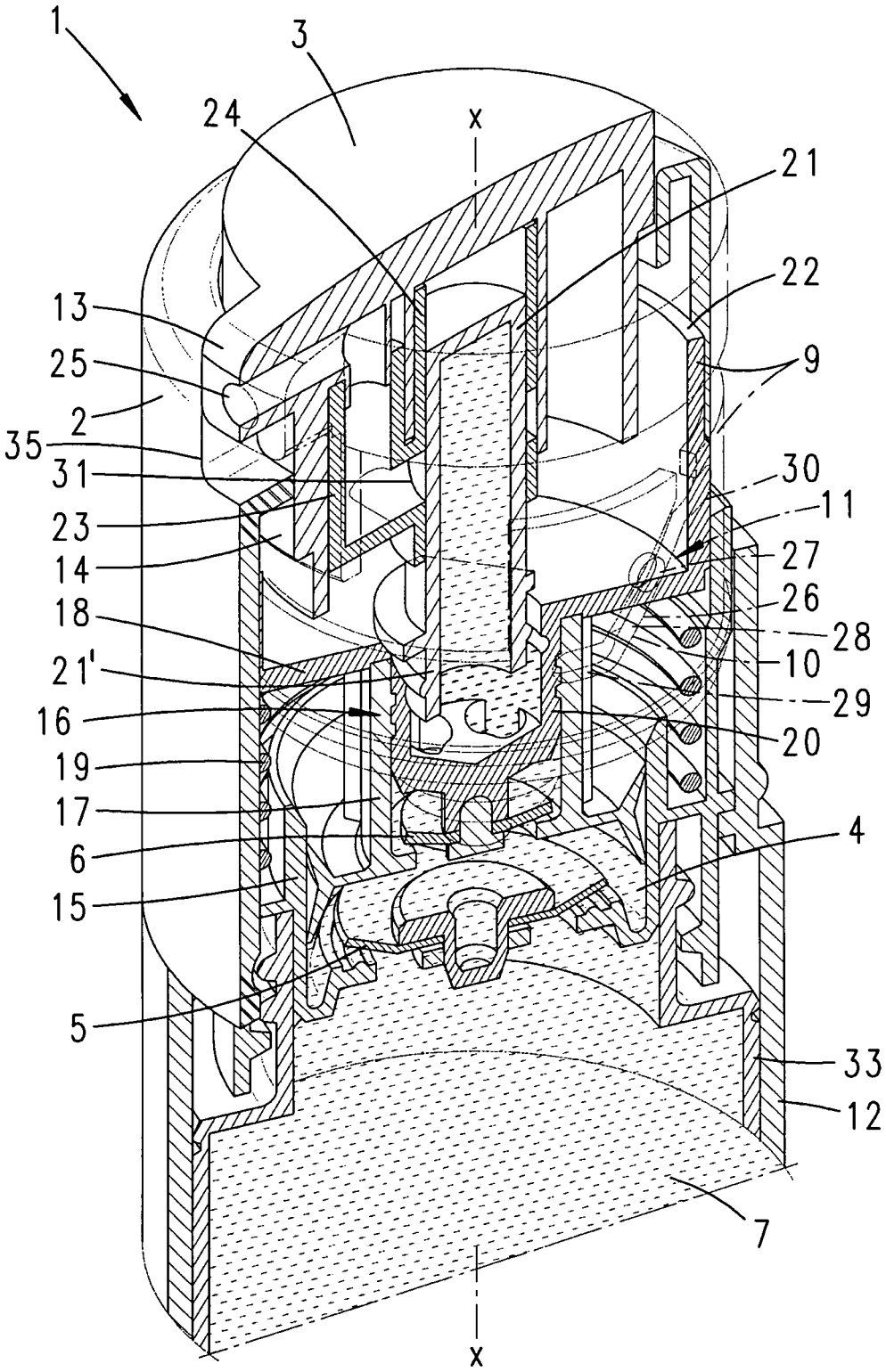
FIG. 5 shows an illustration according to FIG. 4, with the dispensing head partially extended.

The upper pumping-chamber part 16, more specifically, is made up of a piston part 17 and a spring-stop part 18, which engages in this part 17 with latching connection. Acting against the spring-stop part 18 is a restoring spring 19 which, at its other end, is supported on the lower pumping-chamber part 15, outside the pumping chamber 4. A dispensing tube 21 follows, in functional terms, above the pumping-chamber outlet valve 6, this dispensing tube being made up, in part, by an inner surface of a cylindrical engagement portion of the spring-stop part 18 and, in part, by a tube part 21' which is latchingly connected to the engagement portion 20 of the spring-stop part and follows axially in the dispensing direction. The dispensing tube 21 is covered over by the dispensing head 3. In the exemplary embodiment, the tube part 21' is secured against rotation, preferably by positive locking, in relation to the spring-stop part 18. The spring-stop part 18, at the same time, forms an upwardly-free accommodating sleeve 22, in which the head part 3 is accommodated in a telescopic manner (see, for example, FIGS. 3 and 5). In addition, a dispensing-closure part 23 is provided that is rotationally fixed to the head part 3. The dispensing-closure part 23, in the form of a continuation portion, is also part of the dispensing tube 21, and together with the dispensing head 3 it rotates relative to the fixed tube part 21' upon rotary actuation of the dispenser head part 2. For this purpose, it interacts with the tube part 21' by means of a cylinder portion 24. The cylinder portion 24 encloses the tube part 21' on the outside. The angled continuation portion of the dispensing tube in the dispensing-closure part 23 merges into a horizontally-running dispensing portion which forms a dispensing nozzle 13 and has the dispensing mouth 25 formed at its end.

Figure 6:
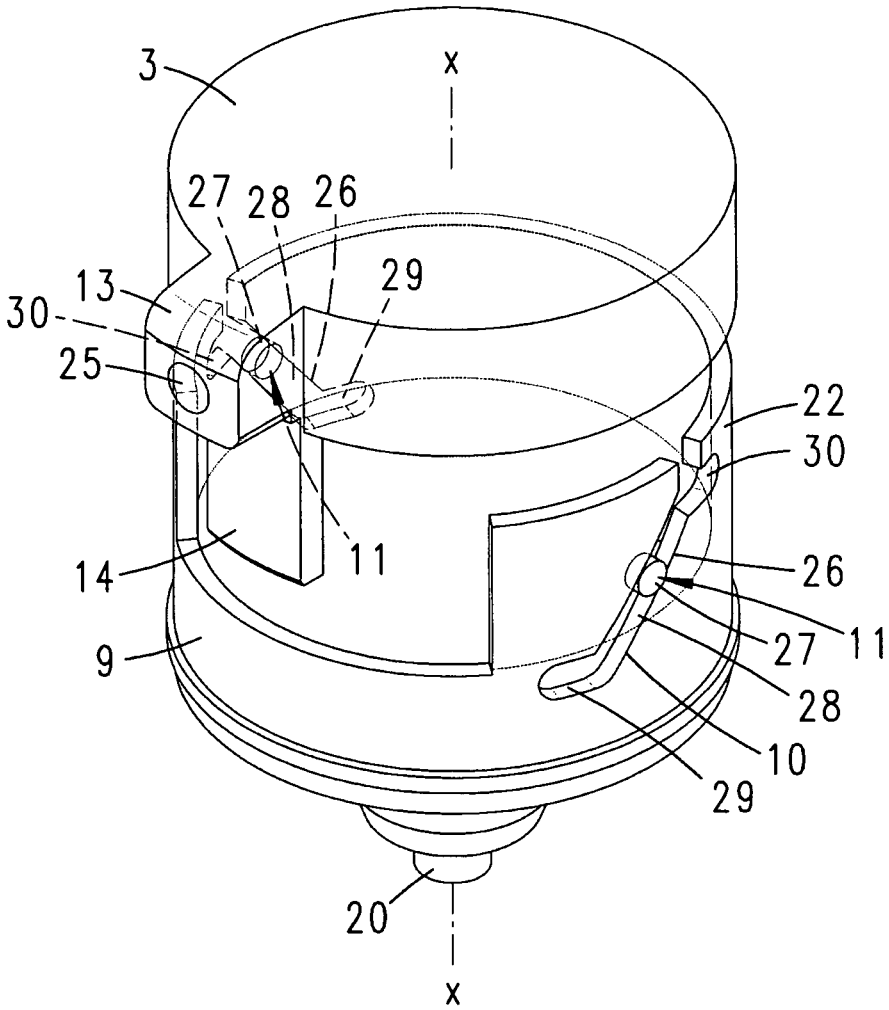
FIG. 6 shows an illustration according to FIG. 5, concentrating on the interaction between the dispensing head and the dispenser head part.

The fixed accommodating sleeve 22, furthermore, forms a slotted track 26, in which runs a sliding block 27 formed on the dispensing head 3, see, for example, FIG. 6.

The slotted track 26 is made up, in specific terms, of an oblique portion 28, a lower retaining portion 29 and an upper retaining portion 30.

When the dispenser head part 2 is rotated relative to the dispenser sleeve part 12, the dispensing head 3 is carried along by way of positive locking. The desired vertical movement of the dispensing head 3 is achieved as a result of the dispensing head 3 being supported by means of the slotted-track guidance on the accommodating sleeve 22, which constitutes a fixed dispenser part.

If, in the extended position, the dispensing head 3 is rotated such that the sliding block 27 is in the upper retaining portion 30, substance can be dispensed by pushing down on, that is to say applying pressure from above to, the dispensing head 3. This is because, at the same time, the opening 31 of the dispensing-closure part 23 and the opening 32 of the tube 21 are aligned in this position, see, for example, FIG. 7.

Figure 3:
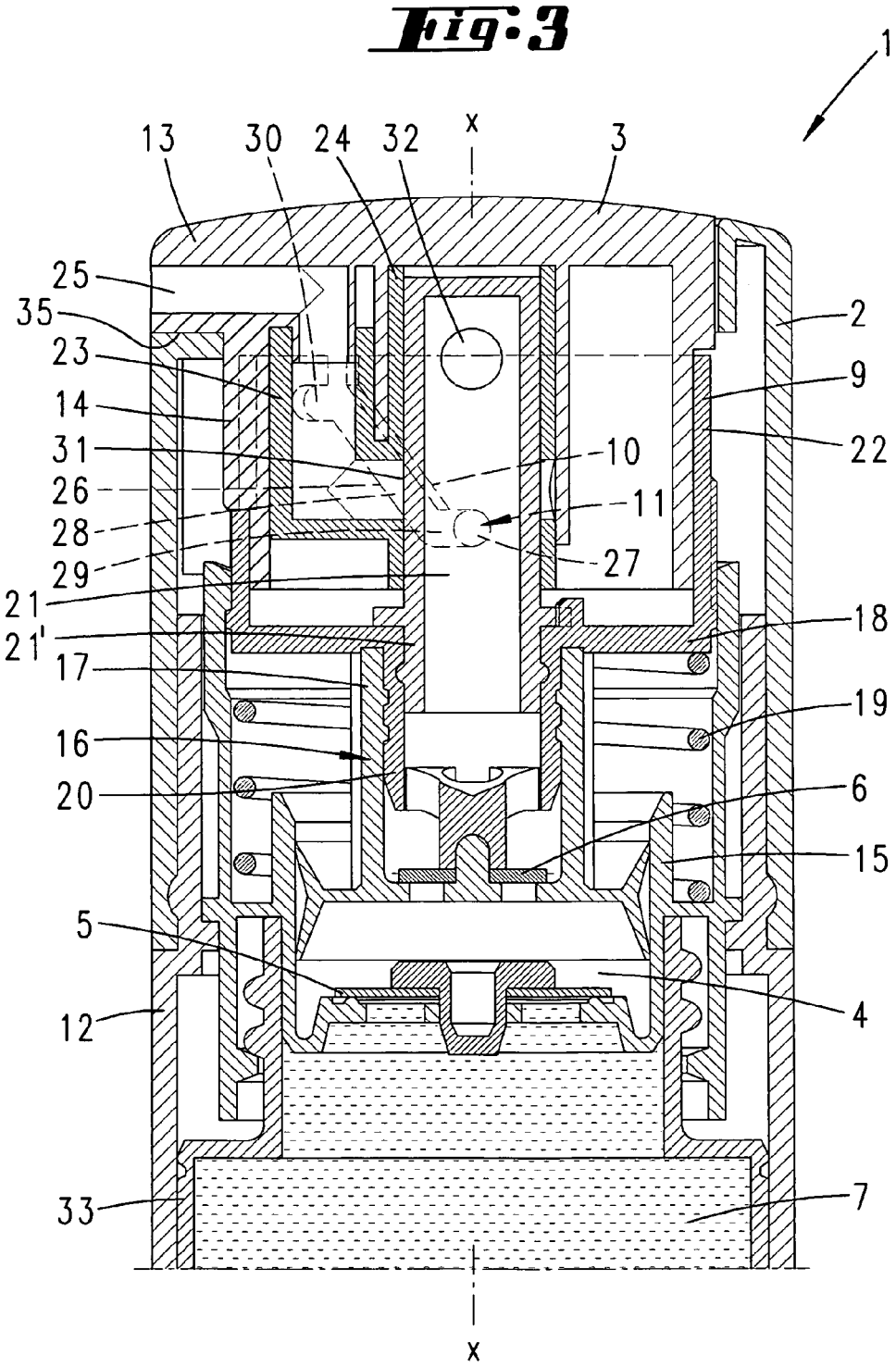
FIG. 3 shows a cross-sectional illustration of the dispenser, in the upper region, with the dispensing head retracted.
Figure 4:
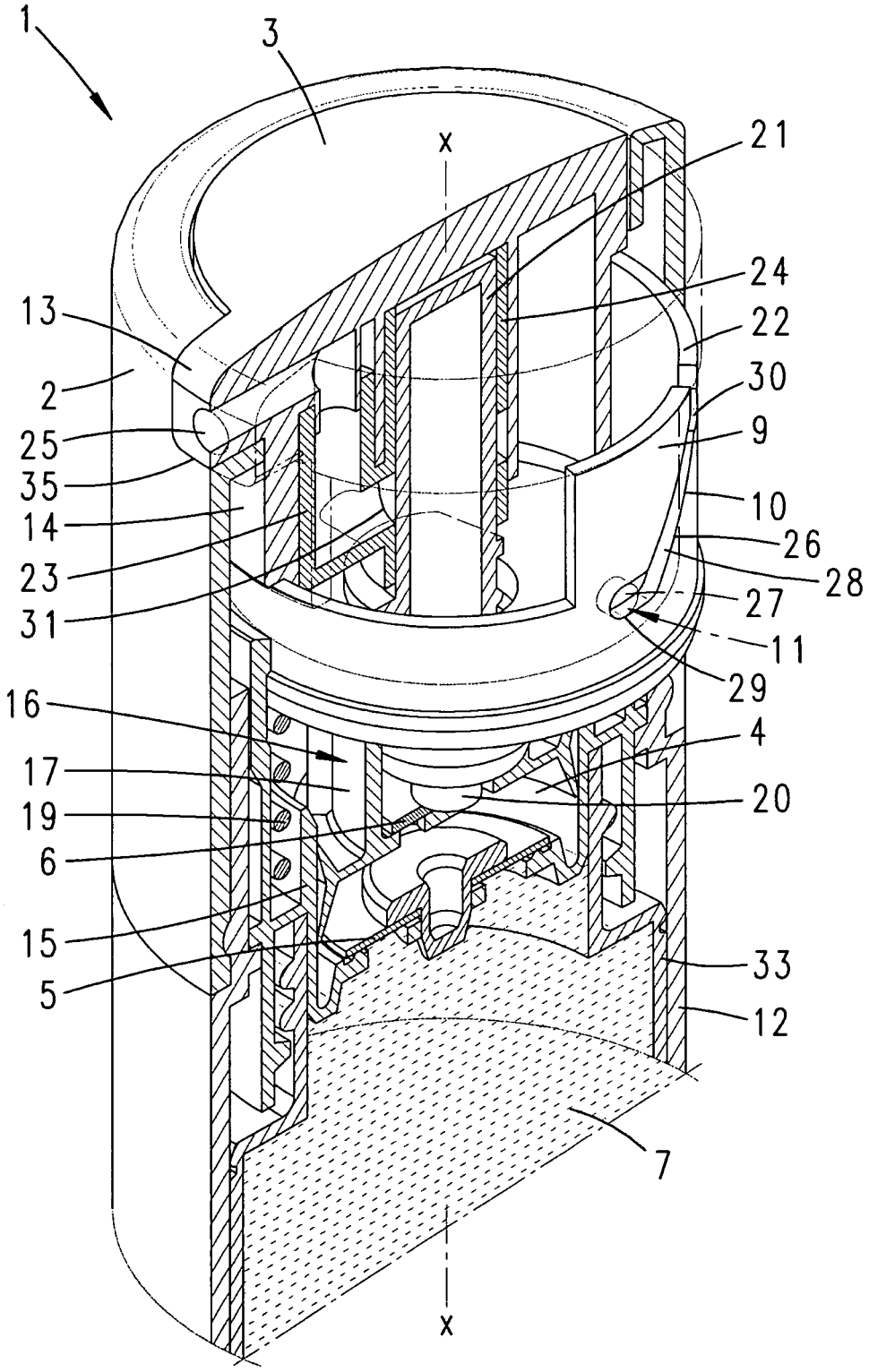
FIG. 4 shows an illustration, partially in perspective, according to FIG. 3.

In the retracted position, in contrast, see, for example, FIG. 3, circumferential and vertical displacement between the openings 31, 32 has the simultaneous effect of the tube portion 21 being moved away. In addition, the radial protrusion of the dispensing head 3, this protrusion having the dispensing mouth 25, is enclosed in a recess 35 of the dispenser head part 2. Downward movement of the dispensing head 3 is thus prevented. This enclosure of the protrusion in the recess can also be utilized for mouth-closure purposes.

Figure 2:
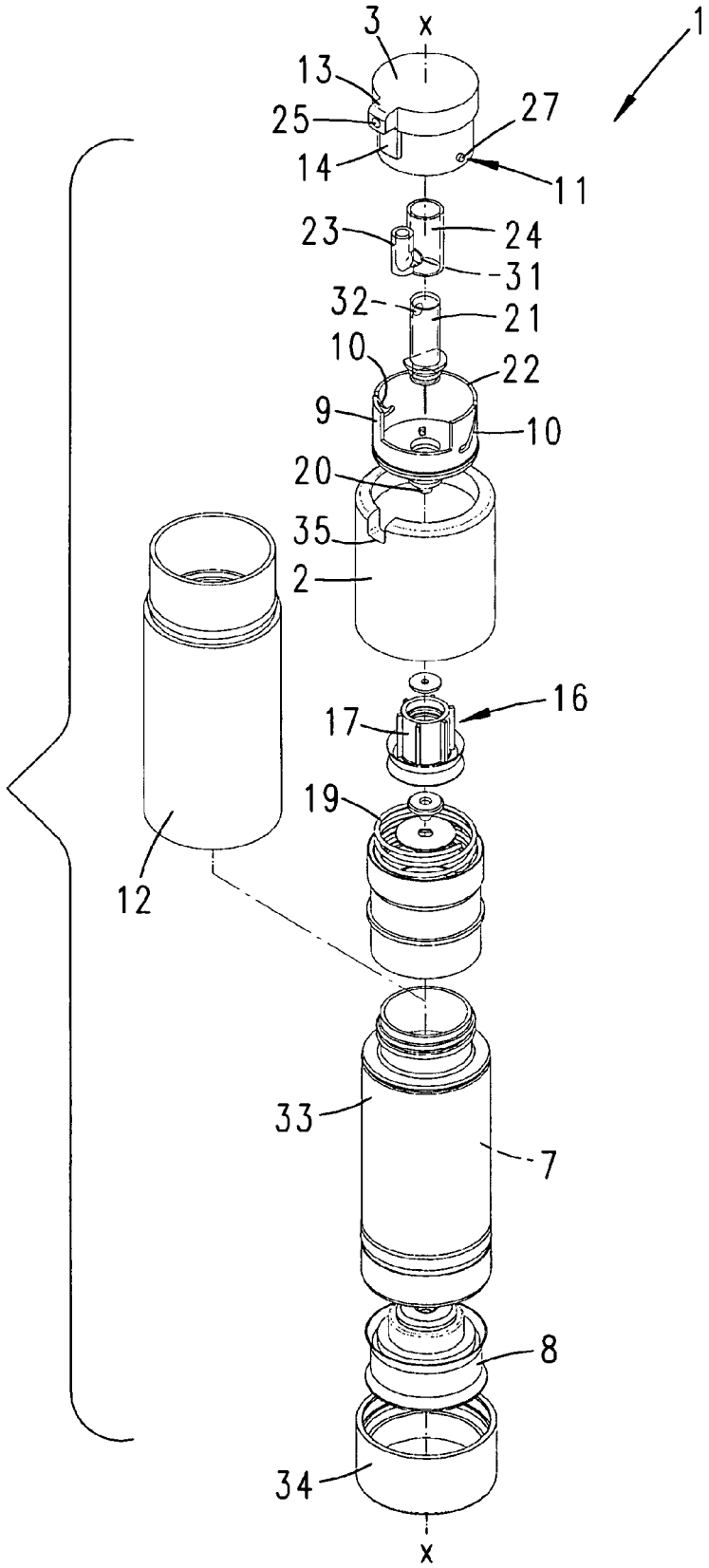
FIG. 2 shows an exploded illustration of the dispenser.

In more specific terms, the lower pumping-chamber part 15 is screwed onto a supply-chamber part 33, see FIG. 3. The supply-chamber part 33 is covered over, on the outside, by the part 12, at any rate over part of its axial extent. Furthermore, a lower cap part 34 covers over a lower part of the extent of the supply-chamber part, a feeding piston 8 being disposed inside the supply-chamber part, see FIG. 2.

In the retracted position, at the same time, the surface of an upper periphery of the dispensing head part 2 is aligned with a surface of the dispensing head 3. The surface may be a planar surface running at right angles to a vertical axis of the dispenser. However, it may also be curved slightly in cross-section, for example, in accordance with the exemplary embodiment, see FIG. 3. A cross-section in the form of part of a circle may also be provided here, in this case with a radius that exceeds a horizontal diameter of the dispenser, which is preferably circular overall. However, the radius, further preferably, is smaller than five times the diameter.

Figure 9:
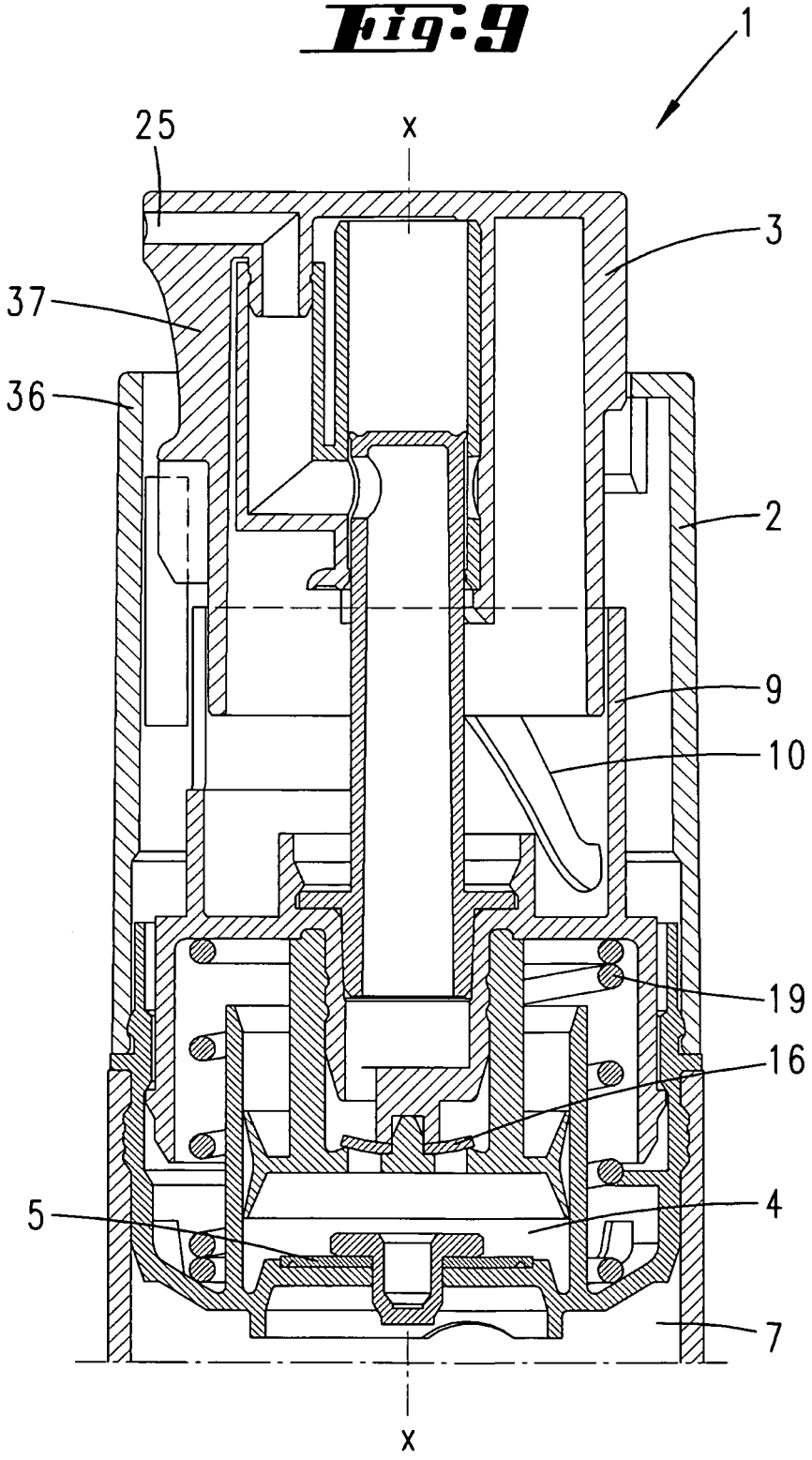
FIG. 9 shows an illustration corresponding to FIG. 7, this time of a further embodiment, and only showing the top part, without a supply chamber.
Figure 10:
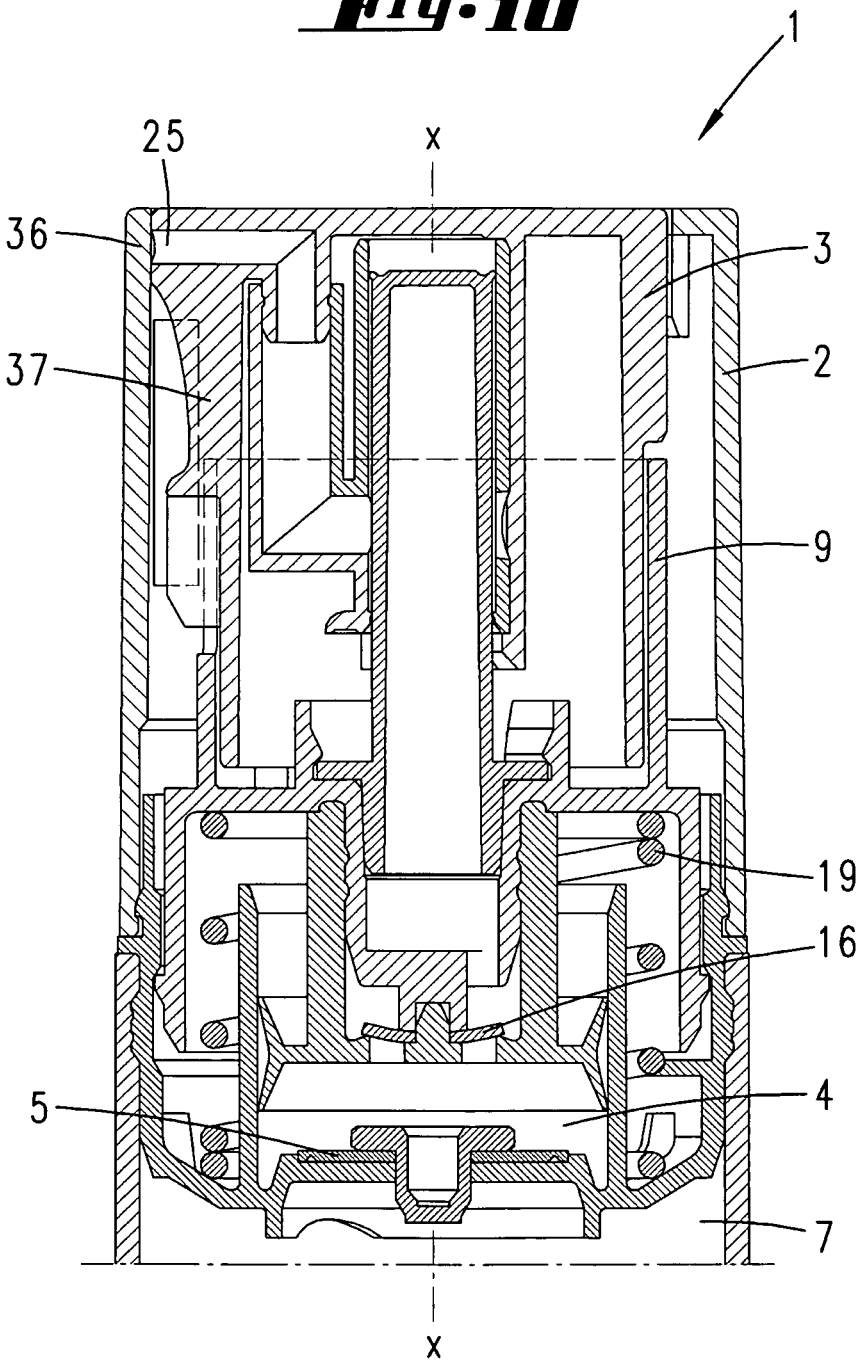
FIG. 10 shows an illustration corresponding to FIG. 9, in the retracted state.
Figure 11:
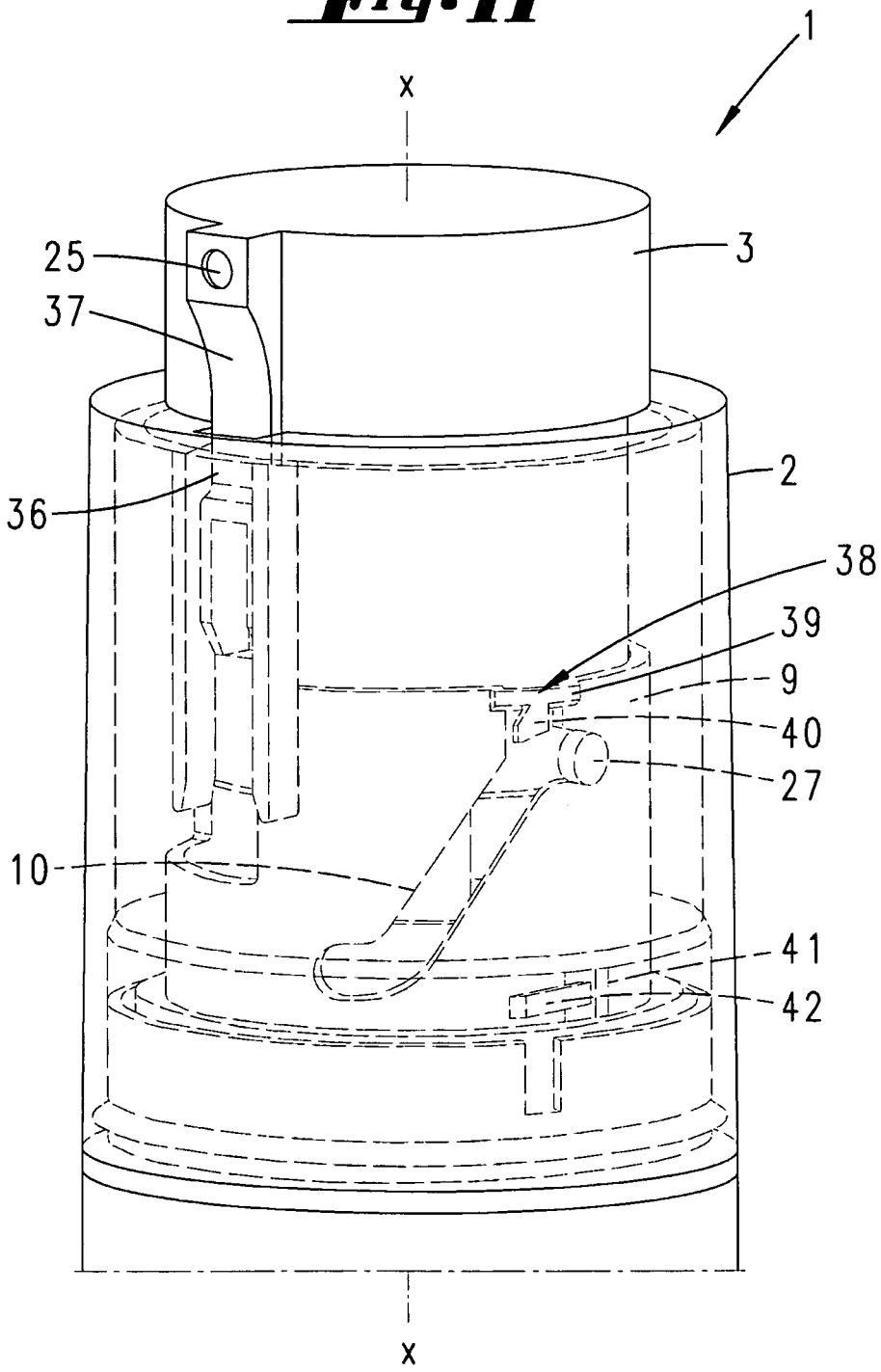
FIG. 11 shows an illustration, partially opened up and in perspective, of the embodiment of FIGS. 9 and 10, in the extended state.

In the embodiment of FIGS. 9 to 11, the surface of an upper periphery of the dispenser head part 2 in the retracted state, FIG. 10, is aligned in a manner corresponding to a planar surface with the surface of the dispensing head 3.

Furthermore, it is important for the dispensing mouth 25, in the retracted state, FIG. 10, to be retracted behind the wall region 36 of the dispenser head part 2, this wall region also terminating in the end surface in the region of the dispensing mouth 25. The wall region in this region, rather than being double-walled, corresponding to the U-shape described, is only single-walled. Beneath the dispensing mouth 25, there follows a wall region 37 of the dispensing head 3, the outside of this wall region running concavely in the cross-section illustrated.

The upper dispenser part illustrated in FIGS. 9 and 10 is also configured with a docking connection, in the form of a latching or snap-fit connection, in respect of the supply container. In the embodiment described above, this connection, in so far as is evident, is a screw connection.

As is evident from FIG. 11 in particular, the slotted actuating track 10 is closed on the upper end by a pull-out barrier 38. The pull-out barrier comprises a locking bar 39 which is positioned on the outer wall and from which a barb part 40 projects downward and inward. With the dispensing head 3 installed, the sliding block 27 moves into the opening of the slotted actuating track 10, this opening being bridged only on the outside by the locking bar 39, and in doing so passes over the barb part 40, with elastic flexing in the outward direction. After this over-running, the barb part 40, which springs back, blocks the dispensing head 3 against possibly being pulled out of the adjustment part 9.

Figure 7:
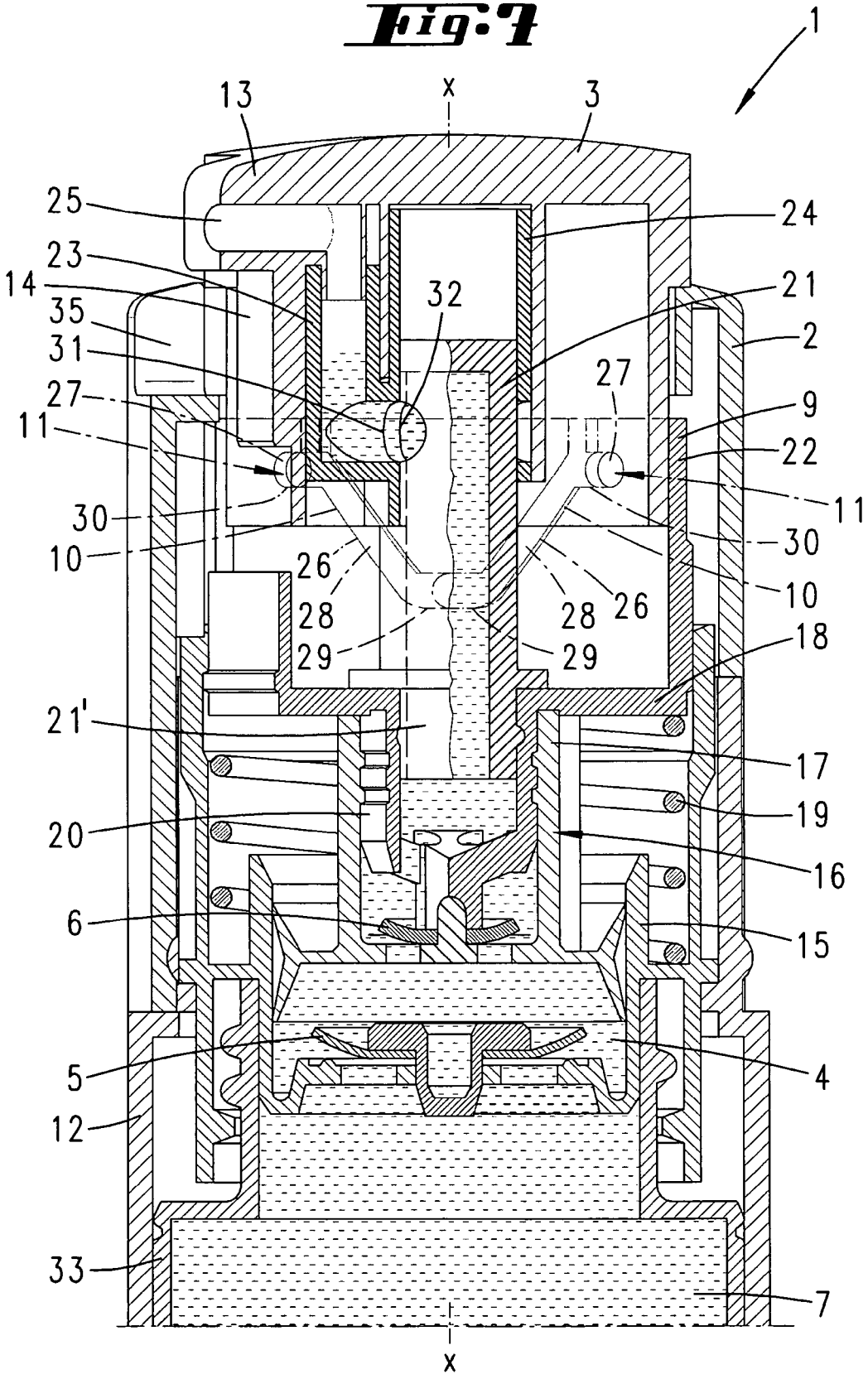
FIG. 7 shows an illustration according to FIG. 3, with the dispensing head fully extended.
Figure 8:
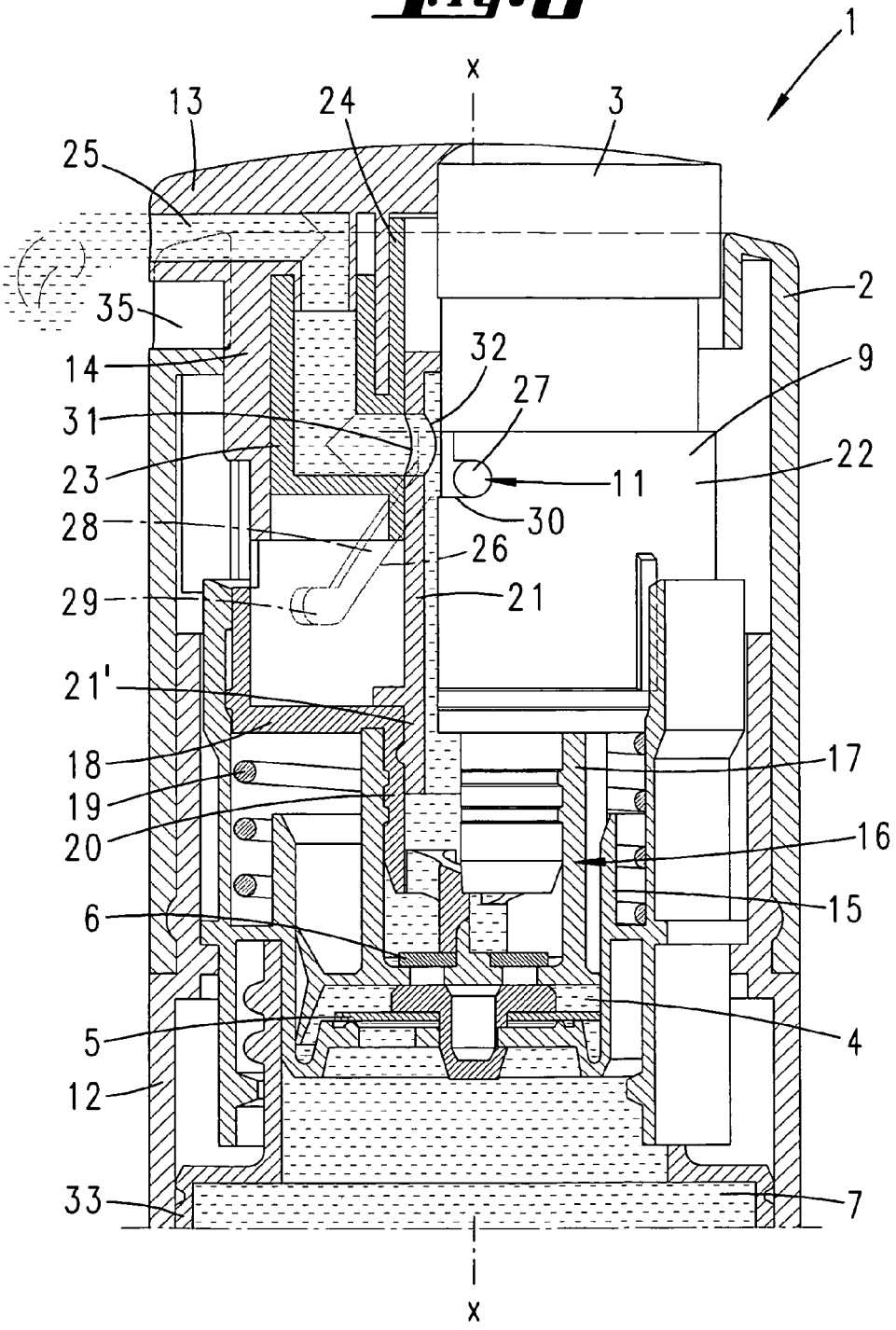
FIG. 8 shows an illustration of the dispensing head in the extended state.

For both embodiments illustrated, it is also important, in particular, that, during displacement of the dispensing head 3 relative to the dispenser head part 2, that is to say during extension or retraction, i.e. a changeover between the positions according to FIGS. 9 and 10 and those according to FIGS. 3 and 7, there is no change in volume in the dispensing-closure part 23 and the following substance path leading to the dispensing mouth 25, on the one hand, and in the tube part 21 and 21', on the other hand. The substance located, as it were, opposite the tube part 21, 21' during upward movement and rotation, and downward movement and rotation, is merely sheared off and/or brought into alignment with the opening 32 of the tube 21, in order that it can then be dispensed during a pumping movement.

It may further be provided, as is also illustrated in FIG. 11, that the fixed adjustment part 9 has fitted on it a protrusion which, during rotation of the dispenser head part 2, is over-run circumferentially by further, inwardly-projecting protrusions (not illustrated specifically). This is done in order to generate a sound, for example a clicking sound, which also provides an acoustic indication to the user that the dispensing head 3 has been fully retracted or extended.

In specific terms, as is evident from FIG. 11, this arrangement may be formed by an opening 41 which is provided, in first instance, in the adjustment part 9 and has a both inwardly and outwardly projecting bar 42 formed, to a certain extent in an elastically movable manner, on its inside, and also by the aforementioned protrusions (not illustrated) projecting from the inner surface of the dispenser head part 2. Of course, the protrusions may be arranged in relation to one another such that the respective sound corresponds to the upper or lower end position of the dispensing head 3.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

The invention claimed is:

1. Dispenser (1) for dispensing liquid to pasty substances, having a dispensing head (3) with a dispensing mouth, having a supply chamber and having a dispenser head part (2), it being possible for the dispensing head (3) to be displaced relative to the dispenser head part (2) out of a dispensing-standby position into a lowered position and vice versa, it being possible for the dispensing head (3), as a result of being supported on a fixed dispenser part (22), to be extended or retracted relative to the fixed dispenser part (22) when being carried along in rotation by the dispenser head part (2), and the dispenser head (3) covering over a dispensing tube (21) that communicates with a pumping chamber, wherein the dispensing head (3), in the extended position, interacts in an aligned manner with a dispensing opening and, in the retracted position, interacts with a closed region of the dispensing tube (21).

2. Dispenser according to claim 1, wherein the dispenser head part (2) is formed in the manner of a sleeve.

3. Dispenser according to claim 1, wherein the dispenser head part (2) has a vertically accessible recess (35) into and out of which moves a projecting dispensing mouth (25) of the dispensing head (3).

4. Dispenser according to claim 1, wherein the dispenser head part (2) can be rotated relative to the supply chamber.

5. Dispenser according to claim 1, wherein the dispensing head (3) is guided by a slotted track relative to the fixed dispenser part (22) which is formed as an adjustment part.

* * * * *